US012188304B2

(12) United States Patent
Ramsauer et al.

(10) Patent No.: US 12,188,304 B2
(45) Date of Patent: Jan. 7, 2025

(54) INSTALLATION KIT, HOLLOW ROD, DRILL STRING AND A METHOD FOR PRODUCING OR REWORKING A HOLLOW ROD OF A DRILL STRING

(71) Applicant: THINK AND VISION GMBH, Leoben (AT)

(72) Inventors: Medardus Ramsauer, Kuchl (AT); Anton Kotov, Samara (RU)

(73) Assignee: THINK AND VISION GMBH, Leoben (AT)

( * ) Notice: Subject to any disclaimer, the term of this patent is extended or adjusted under 35 U.S.C. 154(b) by 0 days.

(21) Appl. No.: 17/913,112

(22) PCT Filed: Jun. 6, 2022

(86) PCT No.: PCT/EP2022/066699
§ 371 (c)(1),
(2) Date: Sep. 20, 2022

(87) PCT Pub. No.: WO2022/268696
PCT Pub. Date: Dec. 29, 2022

(65) Prior Publication Data

US 2023/0340838 A1 Oct. 26, 2023

(30) Foreign Application Priority Data

Jun. 25, 2021 (AT) ..... 50534/2021

(51) Int. Cl.
*E21B 17/02* (2006.01)
*E21B 17/00* (2006.01)

(52) U.S. Cl.
CPC ..... *E21B 17/023* (2013.01); *E21B 17/003* (2013.01)

(58) Field of Classification Search
CPC ..... E21B 17/003; E21B 17/023
See application file for complete search history.

(56) References Cited

U.S. PATENT DOCUMENTS 4,548,431 A * 10/1985 Hall ..... E21B 17/042 285/390
2013/0299237 A1* 11/2013 Johnson ..... E21B 17/0285 175/40

(Continued)

FOREIGN PATENT DOCUMENTS

AT 508 272 1/2011
AT 508 306 1/2013

(Continued)

OTHER PUBLICATIONS

Search Report for AT Application No. A 50534/2021 dated Mar. 23, 2022, 1 page.

(Continued)

*Primary Examiner* — Cathleen R Hutchins
*Assistant Examiner* — Ronald R Runyan
(74) *Attorney, Agent, or Firm* — NIXON & VANDERHYE

(57) ABSTRACT

Installation kit for hollow rods of a pipe string, in particular a drill string, with a first end and a second end, which are connected to one another by at least one connecting line. One of the two ends is arranged in a pin of the hollow rod, and the other end is arranged in a box of the hollow rod. A seal is arranged on the first end and/or on the second end, where the first end of an installation kit that is to be connected is sealed relative to the second end, and a sealing element that seals the respective end relative to the pin or the box is arranged on the peripheral surface of each end.

19 Claims, 6 Drawing Sheets

(56) References Cited

U.S. PATENT DOCUMENTS

| | | | | |
|---|---|---|---|---|
| 2018/0010401 | A1 | 1/2018 | Johnson et al. | |
| 2019/0136640 | A1* | 5/2019 | Nitsche | F16B 2/04 |

FOREIGN PATENT DOCUMENTS

| | | |
|---|---|---|
| DE | 39 12614 | 11/1989 |
| EP | 2 440 737 | 9/2015 |
| EP | 2 593 633 | 2/2018 |
| WO | 92/04525 | 3/1992 |
| WO | 03/012250 | 2/2003 |

OTHER PUBLICATIONS

International Search Report and Written Opinion of the ISA for PCT/EP2022/066699 dated Sep. 2, 2022, 12 pages.

* cited by examiner

INSTALLATION KIT, HOLLOW ROD, DRILL STRING AND A METHOD FOR PRODUCING OR REWORKING A HOLLOW ROD OF A DRILL STRING

CROSS-REFERENCE TO RELATED APPLICATIONS

This application is the U.S. national phase of International Application No. PCT/EP2022/066699 filed Jun. 20, 2022 which designated the U.S. and claims priority to AT A 50534/2021 filed Jun. 25, 2021, the entire contents of each of which are hereby incorporated by reference.

BACKGROUND OF THE INVENTION

Field of the Invention

The invention relates to an installation kit for hollow rods of a pipe string, in particular a drill string; a hollow rod of a pipe string, in particular a drill string; a pipe string, in particular a drill string; and a method for producing or reworking a hollow rod.

Description of the Related Art

An essential element in modern drilling processes, in particular in crude oil, natural gas, and geothermal energy drilling, is the data acquisition and the control of various modules of the drill string during the drilling operation, as well as the power supply of electrical modules in the drill string. The same also applies, however, for the subsequent crude oil, gas, or hot water production, to which the invention also relates. The drilling industry therefore requires a system that makes it possible to transfer energy electrically and/or to transmit data electrically or optically during the drilling process or production process.

Such a system should in this case be as independent as possible of the structural design of the hollow rods, so that both new hollow rods and already present hollow rods can be outfitted using it.

SUMMARY OF THE INVENTION

This object is achieved according to the invention with the disclosed installation kit, as well as the hollow rod and pipe string, in particular a drill string, as also disclosed.

The installation kit according to the invention has a first end and a second end, which are connected to one another by means of at least one connecting line. One of the two ends is arranged in a pin of the hollow rod, and the other end is arranged in a box of the hollow rod. A seal is arranged on the first end and/or on the second end in order to seal one end of an installation kit in a hollow rod relative to the other end of an installation kit that is to be connected. Finally, a sealing element that seals the respective end relative to the pin or the box is arranged on the peripheral surface of each end. Thus, it is possible to outfit or to retrofit hollow rods of generally any design in such a way that an electrical, optical, and/or hydraulic data and/or supply line can be incorporated, which line is largely independent of the actual hollow rod. That is to say that the hollow rods and their connections to attached hollow rods via a pin and a box do not need to be changed when they are outfitted or retrofitted with an installation kit according to the invention.

In the disclosed method, it is only necessary to provide a suitable receptacle inside the pin and the box in a new or an already present old hollow rod by machining the inside surface of the pipe in this area so that the two ends of the installation kit can be accommodated in a reliable and tight manner.

All seals, sealing elements, and packings according to the invention are designed in such a way that they correspond to the safety instructions in connection with electrical current to drilling rigs, and thus no further safety measures need to be concerned.

Additional preferred embodiments of the invention are also disclosed.

The connecting line between the two ends could, according to the invention, already itself be a correspondingly protected electrical, optical, or hydraulic line, but it is preferably a pipe in which an electrical or optical line is or can be accommodated. Of course, empty piping is also possible.

The connecting line, and in particular the pipe, is connected in another preferred embodiment of the invention to both ends at respectively one duct in the ends. Thus, the connecting line or the electrical or optical line arranged in the connecting line can be run securely to a connecting point between the interconnecting ends of the installation kit or hollow rods.

In particular, it is preferred in the invention when one end of the installation kit has a pipe coupling and the other end has a spigot end, and a seal is arranged between the pipe coupling and the spigot end. By the cogging of pipe coupling and spigot end, a mechanically stable connection, on the one hand, and a very reliable packing of the two ends that are to be connected to one another, on the other hand, are ensured.

In this case, in a preferred embodiment of the invention, the spigot end can have a first longitudinal section and a second longitudinal section, wherein the first longitudinal section has a larger outside diameter than the second longitudinal section; wherein the at least one connecting line on the first longitudinal section is connected to the duct; and wherein the duct empties onto a shoulder between the first and second longitudinal sections.

In another preferred embodiment of the invention, the duct empties onto a front side of the pipe coupling, and the at least one connecting line is connected to the duct on a side of the pipe coupling that is opposite to the front side.

These two embodiments of the invention can be combined with one another, at which point the additional possibility according to the invention is offered that the front side of the pipe coupling and the shoulder are separated from one another.

The thus-formed space between the spigot end, the pipe coupling, and a hollow rod can be used for accommodating at least one electrical, optical, hydraulic, or radio system. In particular, in this space, electrical and/or optical systems, such as measuring systems, as well as connections or couplings can be incorporated for connecting the electrical and/or optical lines from one installation kit to the next.

BRIEF DESCRIPTION OF THE DRAWINGS

Additional features and advantages of the invention follow from the subsequent description of a preferred embodiment of the invention that does not limit the scope of protection with reference to the accompanying drawings. Here.

DESCRIPTION OF THE PREFERRED EMBODIMENTS

Figure 1:
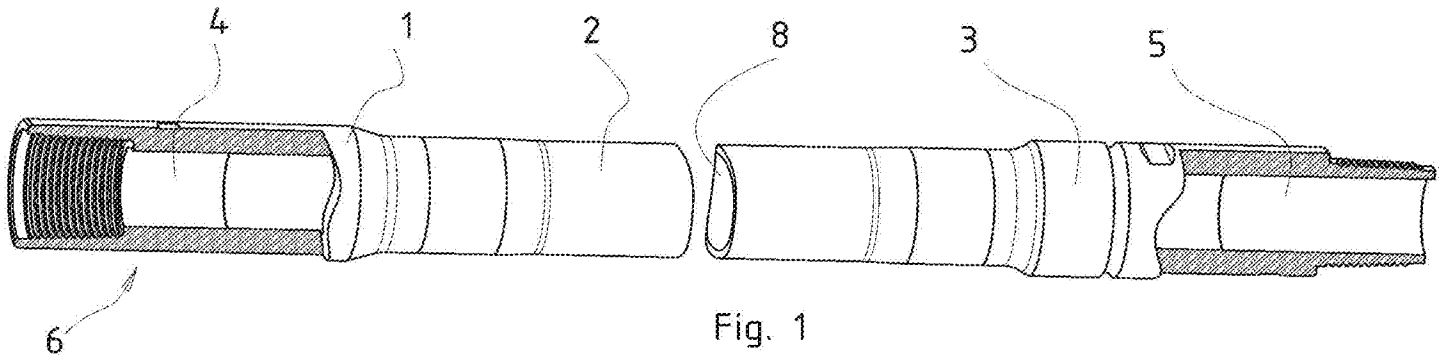
Fig. 1 Prior Art
FIG. 1 shows a hollow rod.
Figure 2:
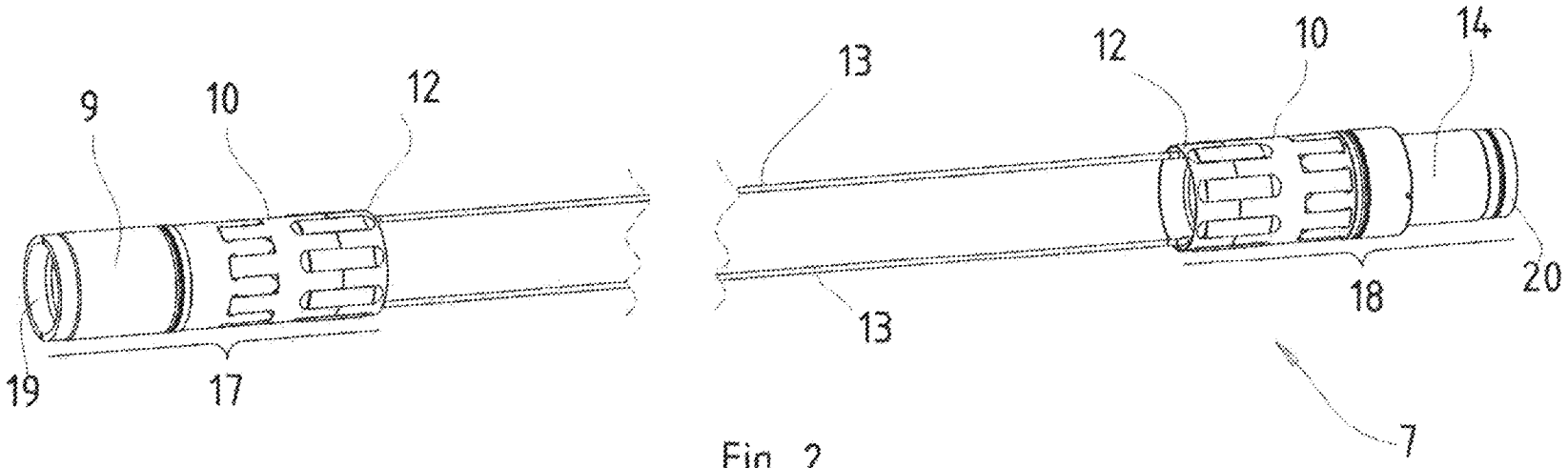
FIG. 2 shows an embodiment of an installation kit according to the invention.
Figure 3:
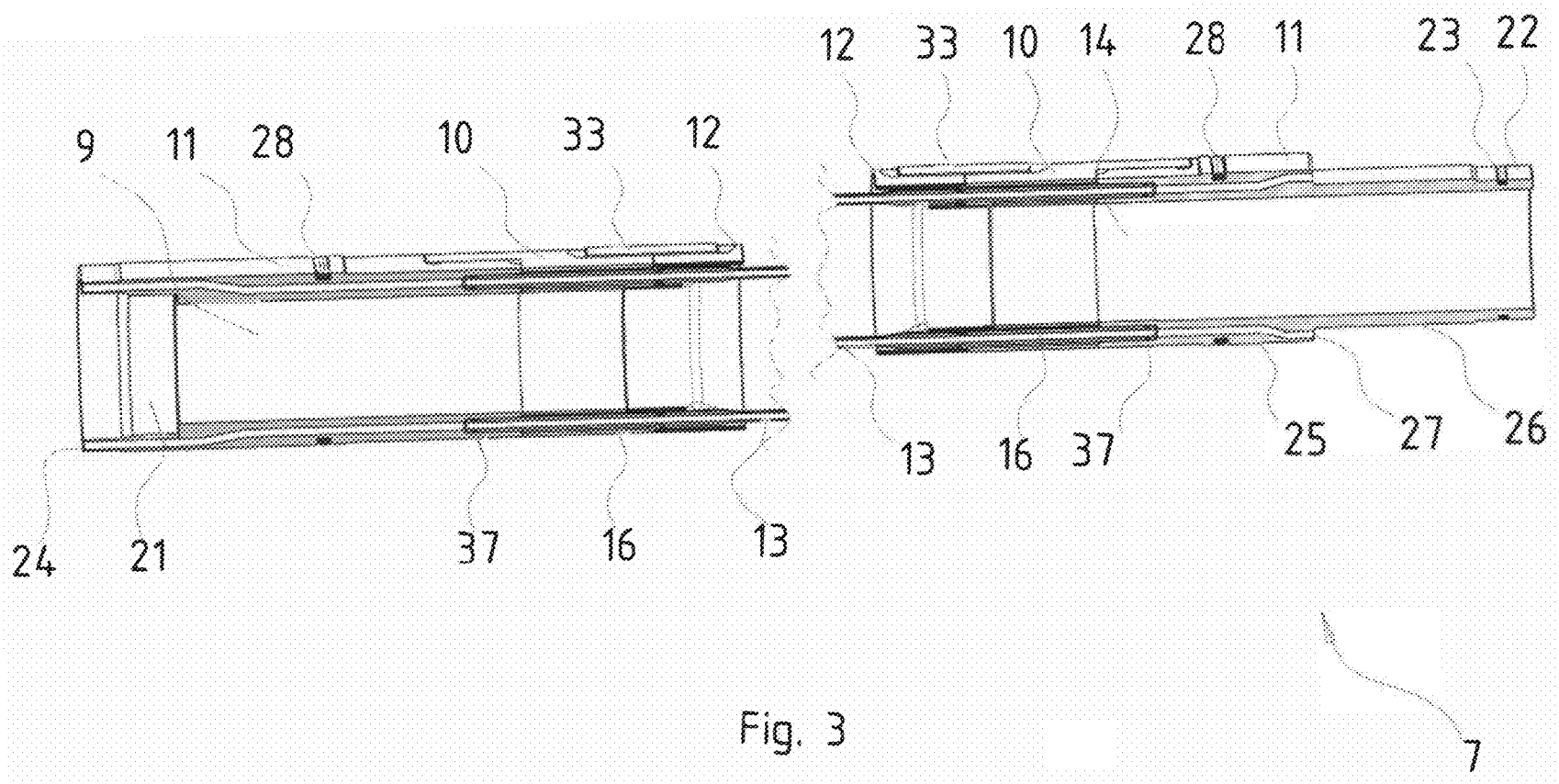
FIG. 3 shows the ends of the installation kit of FIG. 2 on an enlarged scale and in section.
Figure 4:
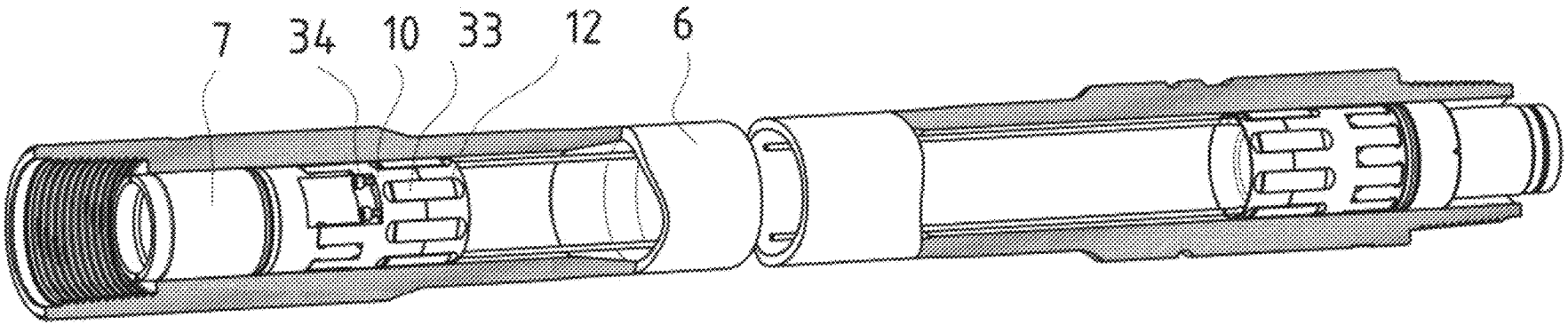
FIG. 4 shows the installation kit according to FIG. 2, incorporated into the hollow rod of FIG. 1, in a partial longitudinal section.
Figures 5, 5A:
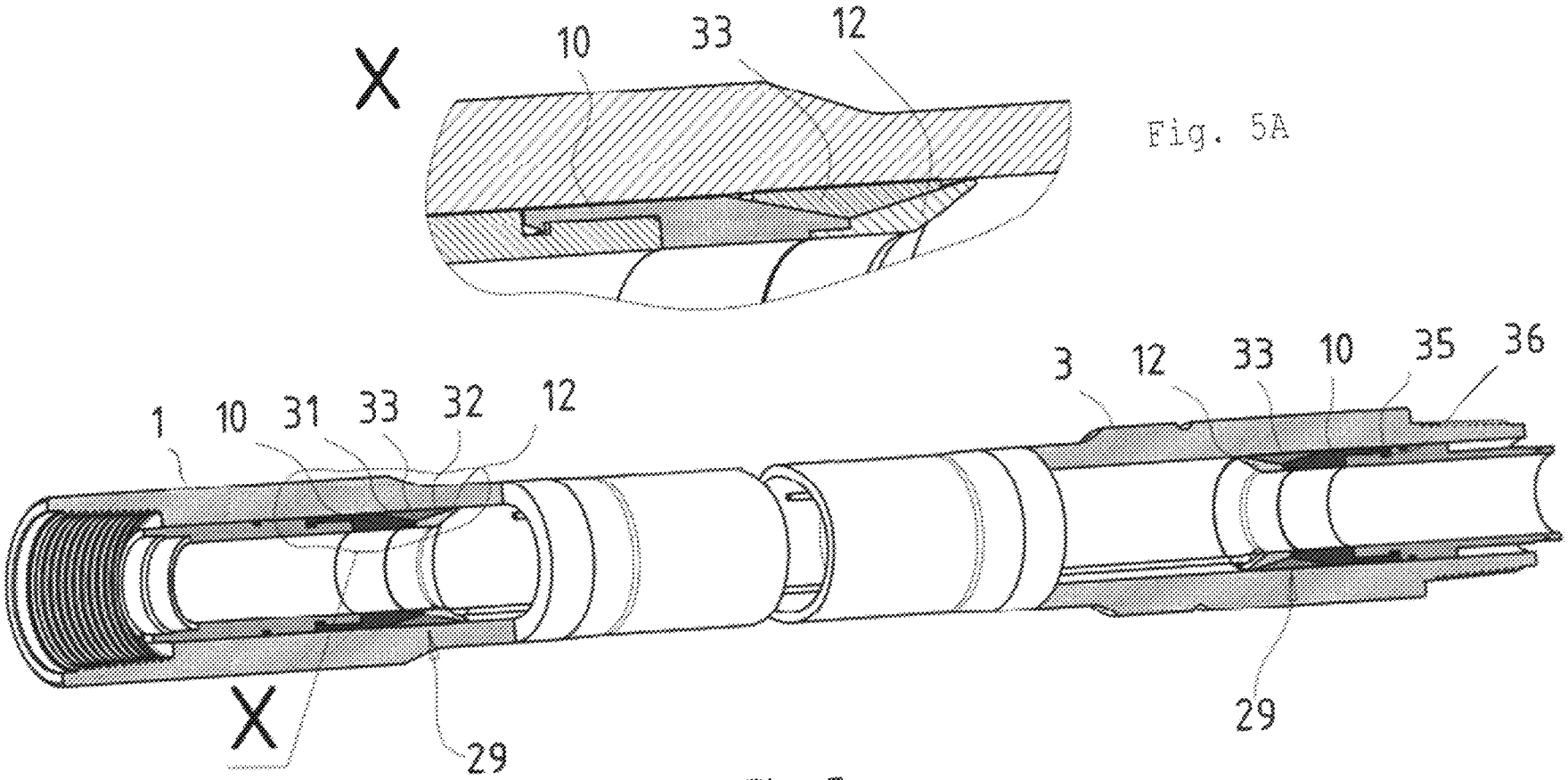
FIG. 5 shows the incorporated installation kit of FIG. 4 with additional details.
FIG. 5A is a detail view of a portion from FIG. 5.
Figure 6:
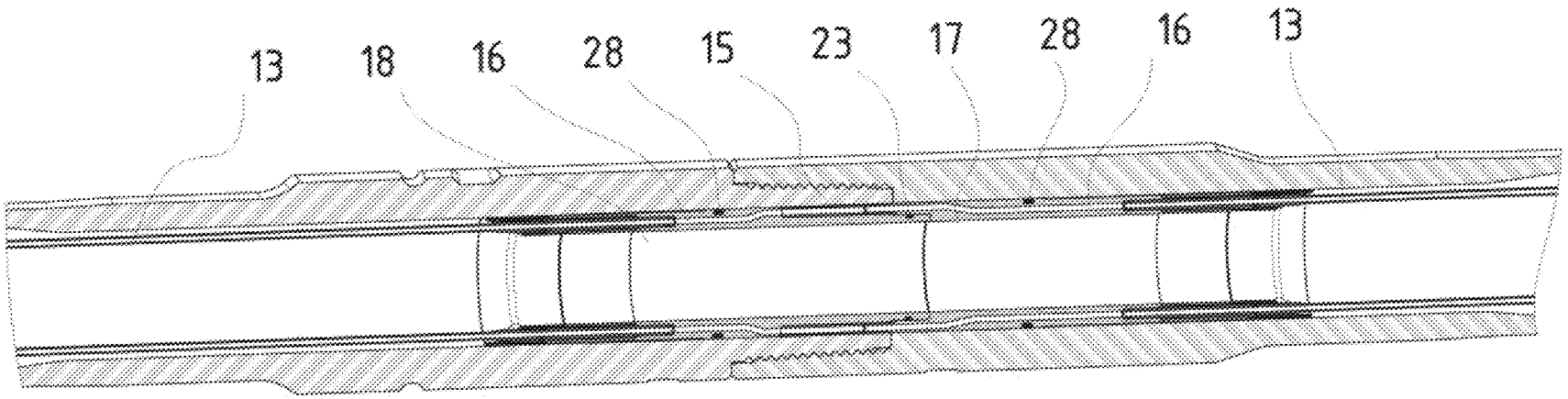
FIG. 6 shows the connecting area of two hollow rods of a drill string with an installation kit according to the invention in a partial section.

In the drawings, an embodiment of an installation kit according to the invention is depicted, which installation kit, however, is intended only as an example, and aside from the features according to the invention as defined in the claims, can also be implemented differently within the scope of this invention as regards many components, without this requiring special mention below.

In FIG. 1, an embodiment of a hollow rod 6 that is common per se in the state of the art is depicted with adjustments according to the invention. It is understood that the hollow rod can also be designed differently if specific features of the hollow rod 6 are not specified below as absolutely necessary features.

In the depicted embodiment, the hollow rod 6 has a pipe body 2, on one end of which is arranged a pin 3 and on the other end of which is arranged a box 1. Preferably, but not necessarily, the box 1 and the pin 3 are welded onto the pipe body 2. An outside thread or threaded connection is attached to the pin 3, and an inside thread or pipe coupling thread is attached in the box 1, wherein the two threads are preferably taper threads. By screwing the threaded connection on the pin 3 into the pipe coupling thread in the box 1, multiple hollow rods 6 can be joined together to form a drill string, wherein this connection provides a sufficiently reliable packing between the interior and exterior of the drill string.

The hollow rod 6 is open end-to-end in its interior, so that a channel 8 is produced in the hollow rods 6 that are screwed onto one another, by which channel, e.g., drilling fluid can be conveyed from the drilling rig to the surface of the drill head. If the hollow rod 6 is not a drill string, but rather a pipe string for the conveying of, for example, oil, gas, or water, the latter can be conveyed upward through the channel 8 into the interior of the hollow rods 6.

In the depicted embodiment, cylindrical holes 4, 5 are preferably located in the area of the box 1 and the pin 3, into which holes a first end 17 and a second end 18 of an installation kit 7 according to the invention are inserted.

In the installation kit 7 according to the invention, depicted in the drawings, the two ends 17, 18 are connected by means of two connecting lines 13. Of course, more than two connecting lines or only a single connecting line can also be present. The connecting lines 13 are tightly connected, for example by means of a seal 37, to ducts 16 in the ends 17, 18.

On the side opposite to the connecting lines 13, the one end 17 has a pipe coupling 19, and the other end 18 has a spigot end 20. The pipe coupling 19 and the spigot end 20 are compatible and can be plugged into one another, so that a connection between two interconnecting installation kits 7 can be produced. In order to be able to produce a tight connection between the pipe coupling 19 and the spigot end 20, the pipe coupling 19 has an inside wall area 21, and the spigot end 20 has an outside wall area 22. The inside wall area 21 and the outside wall area 22 are preferably cylindrical, but can also be conical or concave/convex. A sealing ring 23 is arranged on the outside wall area 22 of the spigot end 20. When the pipe coupling 19 and the spigot end 20 are plugged together, a tight connection of an installation kit 7 with a connecting installation kit 7 is produced via the sealing ring 23.

Alternatively, it is also possible in the invention, however, that the seal is not a separate part, such as a sealing ring, but rather is formed by two sealing surfaces arranged on the pipe coupling 19 and on the spigot end 20, which sealing surfaces are adjacent under pressure, causing the seal to be produced by the sealing surfaces on the pipe coupling 19 and the spigot end 20.

In the pipe coupling 19, the duct 16 runs from the connecting line 13 through the interior of the pipe coupling 19 up to a front side 24, which is opposite to the connecting line 13.

The spigot end 20 has a first longitudinal section 25 and a second longitudinal section 26, which both have an essentially cylindrical shape. The first longitudinal section 25 has a larger outside diameter than the second longitudinal section 26. A shoulder 27 is formed at the transition between the first longitudinal section 25 and the second longitudinal section 26. In the spigot end 20, the duct 16 runs from the connecting line 13 through the interior of the spigot end 20 up to the shoulder 27 and empties there.

The distances between the emptying point of the duct 16 and the front side 24 of the pipe coupling 19 and between the emptying point of the duct 16 and the shoulder 27 of the spigot end 20 of a longitudinal axis of the installation kit 7 are preferably essentially the same, wherein different distances are, of course, also possible, however.

In the depicted embodiment of the installation kit 7 according to the invention, the shoulder 27 of the spigot end 20 and the front side 24 of the pipe coupling 19 are located at a distance that is great enough to form a space 15, in which electrical and/or optical components can be arranged. These components can be, for example, sensors and electrical or electromagnetic connections or couplings, via which energy can be transferred electrically and/or data can be transmitted electrically or optically when the pipe coupling 19 and the spigot end 20 are plugged together.

For example, the device, described in EP 2 440 737 B1, for connecting electrical lines can be incorporated into the space 15, in order to connect to one another electrical lines of interconnecting hollow rods 6 or installation kits 7 that run through the connecting lines 13 and the ducts 16.

The sealing of the ends 17, 18 to the hollow rod 6 is ensured by sealing sleeves 9, 14, which are integrated in the pipe coupling 19 and the spigot end 20 or are connected tightly to the latter. The sealing sleeves 9, 14 have a peripheral surface 11 with a cylindrical shape, on which a sealing element 28 is arranged.

In order to fasten the ends 17, 18 in the pin 3 and in the box 1, a clamping device 29 is provided, which device consists essentially of two sleeves 10, 12, which can be moved relative to one another in the axial direction. Each of the sleeves 10, 12 has a wedge surface 31, 32 on the side facing the other sleeve 10, 12. Between the two sleeves 10, 12, wedges 33, which have wedge surfaces assigned to the wedge surfaces 31, 32, are arranged uniformly distributed around the periphery. The sleeves 10, 12 can be tightly braced against one another by means of screws 34, causing the wedges 33 to be moved radially outward and the clamping device 29 in each case to be clamped in the pin 3 and in the box 1. The clamping devices 29, more precisely their sleeves 10 arranged on the side of the pipe coupling 19 or the spigot end 20, have, in addition, spring projections 35, which can lock in recesses 36 in the pipe coupling 19 or the spigot end 20.

The mounting of an installation kit 7 according to the invention can, for example, be carried out so that first, in each case, a clamping device 29 is inserted into the pin 3 and the box 1 of a hollow rod 6. In this case, the connecting lines 13 are inserted far enough into the holes 38, 39 that are provided in the sleeves 10, 12 to cause them to extend beyond the sleeve 10. If necessary, the clamping devices 29 are then pulled somewhat apart again in order to clamp the connecting lines 13.

Then, the screws 34 are tightened, causing the sleeves 10, 12 to be moved toward one another and the wedges 33 to be pressed radially outward until the clamping devices 29 are fixed in the pin 3 and in the box 1.

Subsequently, the electrical and/or optical lines can be pushed through the connecting lines 13 and the ducts 16 in the prepared pipe coupling 19 and the spigot end 20. Then, the pipe coupling 19 and the spigot end 20 are inserted into the pin 3 and the pipe coupling 1 until the projections 35 lock in the recesses 36, at which point the two ends 17, 18 are mounted securely in the hollow rod 6.

When the two ends 17, 18 are fastened in the pin 3 and the box 1 in the way depicted in the figures and described above, the space 15 is sealed with respect to the environment, i.e., in the area outside of the hollow rod 6, on the one hand, and the channel 8 in the interior of the hollow rod 6, on the other hand, but remains open to the ducts 16 by the seal 23 between the pipe coupling 19 and the spigot end 20, the sealing elements 28 between the peripheral surface 11 of each end 17, 18, and the pin 3 and the box 1, as well as the packing on interconnecting hollow rods 6 in the screw connection between the pin 3 and the box 1. Since the ducts 16 in turn are well sealed relative to the connecting line(s) 13, no critical connection or leak relative to the environment even exists here, either.

With the installation kit according to the invention, a system solution that is largely independent of the geometry of the hollow rods 6 can be provided in a simple way, with which hollow rods 6 can be supplemented by the possibility of having a tight and thus more reliable option for laying electrical and optical lines.

The installation kit according to the invention can be used not only in the production of new hollow rods, but also for retrofitting older hollow rods that have already been in operation for an extended period.

In this case, it is only necessary to process an inside surface of the pipe in the pin 3 and in the box 1 and to produce cylindrical holes 4, 5, into which the two ends 17, 18 of the installation kit 7 fit exactly. Since, in this case, this is a relatively simple processing step, the latter can be performed not only in workshops that are well outfitted for this purpose but also on a drilling rig on site.

With the installation kit 7 according to the invention, it is also possible in addition to rework the thread on the pin 3 and in the box 1, which is necessary at regular intervals because of wear and tear or damage to the thread. In this case, it is only necessary to remove the installation kit 7 from a hollow rod 6, to rework the thread, and to insert the installation kit 7 again into the hollow rod 6. A shortening of the connecting line 13 between the two ends 17, 18, which is necessary in any case because of the shortening of the length of the hollow rod 6, can also be easily implemented.

Thus, the reworking of the thread of hollow rods 6 can also be implemented in a simple way on site.

REFERENCE SYMBOL LIST

1 Box
2 Pipe body
3 Pin
4 Cylindrical hole
5 Cylindrical hole
6 Hollow rod
7 Installation kit
8 Channel
9 Sealing sleeve
10 Sleeve
11 Peripheral surface
12 Sleeve
13 Connecting line
14 Sealing sleeve
15 Space
16 Ducts
17 End
18 End
19 Pipe coupling
20 Spigot end
21 Inside wall area
22 Outside wall area
23 Sealing ring
24 Front side
25 First longitudinal section
26 Second longitudinal section
27 Shoulder
28 Sealing element
29 Clamping device
30 -
31 Wedge surface
32 Partial [sic] surface
33 Wedges
34 Screws
35 Projections
36 Recesses
37 Seal
38 Hole
39 Hole

The invention claimed is:

1. An installation kit for hollow rods of a pipe string, comprising:

a first end and a second end, which are connected to one another by means of at least one connecting line, wherein each of the first and second ends has a peripheral surface, two sealing elements, one of the two sealing elements located respectively on the peripheral surface of the first end and the other of the two sealing elements located on the peripheral surface of the second end, wherein one of the first and second ends can be arranged in a pin of the hollow rod with the one of the two sealing elements sealing the one of the first and second ends to the pin and with a first clamping device that fastens the one of the first and second ends in the pin, wherein the other of the first and second ends can be arranged in a box of the hollow rod with the other of the two sealing elements sealing the other of the first and second ends to the box and with a second clamping device that fastens the other of the first and second ends in the box, and a seal, wherein the seal is arranged on at least one of the first end and the second end, wherein the first end is sealed by the seal relative to the second end.

2. The installation kit according to claim 1, wherein the at least one connecting line is connected to respectively one duct in the first and the second ends.

3. The installation kit according to claim 2, wherein the connecting line is accommodated to move in the duct in the longitudinal direction via a further seal.

4. The installation kit according to claim 2, wherein one of the first end and the second end has a pipe coupling and the other of the first end and the second end has a spigot end, and wherein the seal is arranged between the pipe coupling and the spigot end.

5. The installation kit according to claim 4, wherein the spigot end has a first longitudinal section and a second longitudinal section; wherein the first longitudinal section has a larger outside diameter than the second longitudinal section; wherein the at least one connecting line is connected to the duct on the first longitudinal section; and wherein the duct empties onto a shoulder between the first longitudinal section and the second longitudinal section.

6. The installation kit according to claim 5, wherein the duct empties onto a front side of the pipe coupling, and wherein the at least one connecting line is connected to the duct on a side of the pipe coupling that is opposite to the front side.

7. The installation kit according to claim 6, wherein the front side of the pipe coupling and the shoulder are separated from one another.

8. The installation kit according to claim 2, wherein at least one electrical, optical, or hydraulic line is arranged in the at least one connecting line and the ducts, or wherein the connecting line is empty.

9. The installation kit according to claim 1, wherein the peripheral surface of at least one of the first end and the second end has a shape that is cylindrical at least in sections.

10. The installation kit according to claim 9, wherein the peripheral surface on the spigot end and/or on the pipe coupling is arranged on a sealing sleeve that in each case surrounds the spigot end and the pipe coupling, on which sleeve the sealing element is arranged.

11. A hollow rod of a pipe string, with a pin and a box and a pipe body arranged between the pin and the box, wherein the installation kit is arranged in the hollow rod according to claim 1.

12. The hollow rod according to claim 11, wherein the pin and the box have cylindrical holes, in which the ends of the installation kit are accommodated.

13. The hollow rod according to claim 11, wherein at least one sealing ring is arranged on at least one end of the installation kit as a sealing element.

14. A pipe string, with at least two hollow rods, each of the hollow rods comprising a pin end and a box end, the at least two hollow rods being connected to one another with the pin end of one hollow rod connecting to the box end of an adjacent hollow rod with a pin and a box and a pipe body arranged between the pin and the box, wherein the pin and the box of interconnecting hollow rods are connected tightly to one another, wherein the hollow rods are designed according to claim 11.

15. The pipe string according to claim 14, wherein a space is formed for accommodating at least one electrical, electronic, or optical system between the spigot end, the pipe coupling, and a hollow rod.

16. The pipe string according to claim 15, wherein the space is sealed with respect to the environment, but remains open to the ducts, by the seal between the first end and the second end, the sealing elements between the peripheral surface of each end, and the pin and the box, as well as the packing between the pin and the box of interconnecting hollow rods.

17. The installation kit according to claim 1, wherein the clamping device comprises two sleeves and screws, wherein the two sleeves are movable relative to one another in the axial direction and the screws brace the two sleeves against one another.

18. An installation kit for hollow rods of a pipe string, comprising:

a first end and a second end, which are connected to one another by means of at least one connecting line, wherein each end has a peripheral surface, wherein one of the two ends can be arranged in a pin of the hollow rod, and the other end can be arranged in a box of the hollow rod, wherein a seal is arranged on the first end and/or on the second end, where the first end of an installation kit that is to be connected is sealed relative to the second end, wherein a sealing element is arranged on the peripheral surface of each end, wherein at least one end is fastened in the pin or the box by means of a clamping device, wherein the clamping device has two sleeves that can move in the axial direction and that can be screwed against one another, wherein a wedge surface is arranged on at least one of the sleeves, and wherein wedges that can move in the radial direction on the wedge surface are arranged between the sleeves.

19. A method for producing or reworking a hollow rod of a pipe string with a pin and a box and a pipe body arranged between the pin and the box, wherein an inside surface of a pipe is machined in the pin and in the box, wherein then the installation kit is incorporated into the hollow rod and comprises:

a first end and a second end, which are connected to one another by means of at least one connecting line, wherein each end has a peripheral surface, wherein one of the two ends can be arranged in a pin of the hollow rod, and the other end can be arranged in a box of the hollow rod, wherein a seal is arranged on the first end and/or on the second end, where the first end of an installation kit that is to be connected is sealed relative to the second end, wherein a sealing element is arranged on the peripheral surface of each end, wherein the pin and the box have a thread, wherein the thread is reworked, and wherein then the installation kit is incorporated into the hollow rod.

* * * * *